US006401299B1

(12) United States Patent
Schwarz

(10) Patent No.: US 6,401,299 B1
(45) Date of Patent: Jun. 11, 2002

(54) FOLDING HINGE

(75) Inventor: Helmut Schwarz, Weil der Stadt (DE)

(73) Assignee: SCHWARZ Verbindungs-Systeme GmbH, Althengstett (DE)

( * ) Notice: Subject to any disclaimer, the term of this patent is extended or adjusted under 35 U.S.C. 154(b) by 0 days.

(21) Appl. No.: 09/644,205

(22) Filed: Aug. 23, 2000

(30) Foreign Application Priority Data

Aug. 24, 1999 (DE) ..... 299 14 746 U

(51) Int. Cl.[7] ..... E05D 11/10

(52) U.S. Cl. ..... 16/335; 16/357; 16/361; 296/76

(58) Field of Search ..... 16/357, 359, 335, 16/361, 289, 32; 49/339, 332, 386; 296/76

(56) References Cited

U.S. PATENT DOCUMENTS

| | | | | |
|---|---|---|---|---|
| 1,066,560 A | * | 7/1913 | Westby | 16/361 |
| 4,402,111 A | * | 9/1983 | Selby et al. | 16/361 |
| 4,530,412 A | * | 7/1985 | Sigety, Jr. | 16/361 |
| 4,828,208 A | * | 5/1989 | Peterson et al. | 16/32 |
| 4,882,807 A | * | 11/1989 | Frye et al. | 16/361 |
| 5,050,270 A | * | 9/1991 | Burgei et al. | 16/361 |
| 6,167,977 B1 | * | 1/2001 | Adamson et al. | 16/357 |
| 6,292,981 B1 | * | 9/2001 | Ford et al. | 16/357 |

FOREIGN PATENT DOCUMENTS

| | | |
|---|---|---|
| CH | 330752 | 8/1958 |
| DE | 6904521 | 2/1969 |
| DE | 2232379 | 1/1974 |
| DE | 2429842 | 1/1975 |
| DE | 4240790 | 2/1994 |

OTHER PUBLICATIONS

An English Language abstract of DE 42 40 790.

* cited by examiner

*Primary Examiner*—Lynne H. Browne
*Assistant Examiner*—Doug Hutton
(74) *Attorney, Agent, or Firm*—Greenblum & Bernstein, P.L.C.

(57) ABSTRACT

A pivoting hinge joint having two end stop positions including a pivot arm including a first guideway, a stationary guide including a second guideway having a bent configuration with a turning point, a pivot axis for allowing the pivot arm to pivot with respect to the stationary guide, a guide member adapted to be guided in the first and second guideways, at least one spring adapted to bias the guided member to a first stop position and a second stop position, wherein the turning point is disposed between the first stop position and the second stop position and wherein the pivot arm pivots with respect to the stationary guide between the first stop position and the second stop position.

21 Claims, 2 Drawing Sheets

FOLDING HINGE

CROSS-REFERENCE TO RELATED APPLICATIONS

The present application claims priority under 35 U.S.C. § 119 of German Patent Application No. 299 14 746.0, filed on Aug. 24, 1999, the disclosure of which is expressly incorporated by reference herein in its entirety.

BACKGROUND OF THE INVENTION

1. Field of the Invention

The invention concerns a pivoting hinge joint with a stationary hinge part and a pivoting hinge part which are joined to one another by a pin.

2. Discussion of Background Information

Such a pivoting hinge joint may serve as a device for e.g., holding a lid in a closed and/or locked position or in an opened position.

In the German disclosure document No. 2232379, a hinged lid with a self adhering closed and open position is described, where the lid is guided by a tappet which is guided in a groove with a right-angled bend under a force exerted by a tension spring.

In the German patent document No. DE 4240 790, a hinge for an upward pivoting hood of a motor vehicle is described which comprises a coupling rod with two specially formed guiding bars, a tension spring and a control lever for the coupling rods which can be folded into a guiding member and locked into this.

SUMMARY OF THE INVENTION

The invention provides for a pivoting hinge joint of a design which is simple to manufacture and permits easy handling with reference to its two stop-end positions, i.e., closed, open.

The invention provides a pivoting hinge joint with two end stop positions, characterised by a pivot arm and a stationary guiding piece, a pivot axis of the pivot arm, which is joined to the guiding piece and a guided member which can be guided in a guideway of the pivot arm and in a guideway of the guiding piece. The guideway of the guiding piece is not straight and is fitted with a turning point. At least one spring, by which the guided member is held in either of two stop positions, and that the pivoting motion of the pivoting arm for the path of the guided member from the stop-end position to the turning point, takes place against the force of the spring, and that from turning point the pivot arm can be pressed by the force of the spring into the other stop-end position.

The arrangement may also be characterised by the fact that the pivoting motion of the pivot arm from a stop-end position up to the turning point takes place against the increasing force of the spring.

The arrangement may be characterised by the fact that the spring is at least a torsion spring, through the ends of which pressure is applied to the guided member and the pivot arm.

The arrangement may further be characterised by the fact that the pivot arm is fitted with a retaining axis for holding the torsion spring.

According to one aspect of the invention, there is provided a pivoting hinge joint having two end stop positions, and a pivot arm having a first guideway, a stationary guide including a second guideway having a bent configuration and a turning point, a pivot axis for allowing the pivot arm to pivot with respect to the stationary guide, a guide member adapted to be guided in the first and second guideways, and at least one spring adapted to bias the guided member to a first stop position and a second stop position. The turning point is disposed between the first stop position and the second stop position and the pivot arm pivots with respect to the stationary guide between the first stop position and the second stop position. The pivot axis may be attached to the stationary guide. The turning point may force the guide member against a biasing force of the spring. The spring may force the guide member against one of the first stop position and the second stop position when the guide member moves away from the turning point. The spring may bias the guide member throughout its movement in the first and second guideways. The spring may bias the guide member throughout a pivoting movement of the pivot arm from the first stop position to the second stop position. The spring may include a torsion spring. The spring may include one end which applies pressure to the guide member and another end which applies pressure to the pivot arm.

The hinge may further include a retaining axis disposed on the pivot arm for holding the spring. The first guideway may include an L-shape slot and wherein the second guideway include an elongated slot. At least one of the pivot axis and the guide member may include a pin. The pivot arm may include two side walls and wherein the first guideway include an elongated slot disposed in each side wall, the slots being aligned with one another. The stationary guide may include two side walls and wherein the second guideway includes an L-shaped slot disposed in each side wall, the L-shaped slots being aligned with one another.

The invention also provides for a pivoting hinge joint having two end stop positions, including a pivot arm including two side walls and a first guideway, the first guideway including an elongated slot, a stationary guide including two side walls and a second guideway, the second guideway including an L-shaped slot and a turning point, a pivot axis pivotally connecting the pivot arm to the stationary guide, a guide member movably guided in each of the first and second guideways, and a spring biasing the guided member to a first stop position and a second stop position. The turning point is disposed between the first stop position and the second stop position and the pivot arm pivots with respect to the stationary guide from the first stop position to the second stop position while the spring biases the guide member.

The turning point may force the guide member against a biasing force of the spring. The spring may force the guide member against one of the first stop position and the second stop position when the guide member moves away from the turning point. The hinge may further include a retaining axis disposed on the pivot arm for holding the spring. At least one of the pivot axis and the guide member may include a pin. The stationary guide may include a U-shaped bracket with substantially perpendicular flanges extending from the side walls. The pivot arm may include an attachment flange having at least one hole.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
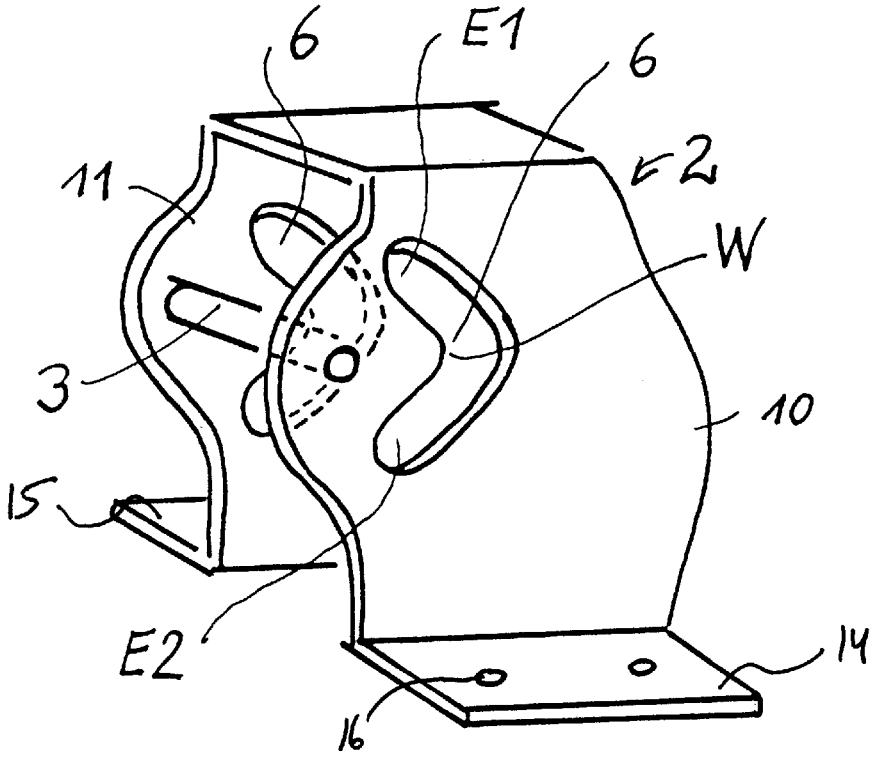
FIG. 1 shows a simplified perspective drawing of the stationary hinge part and the pivoting hinge part.
Figure 1:
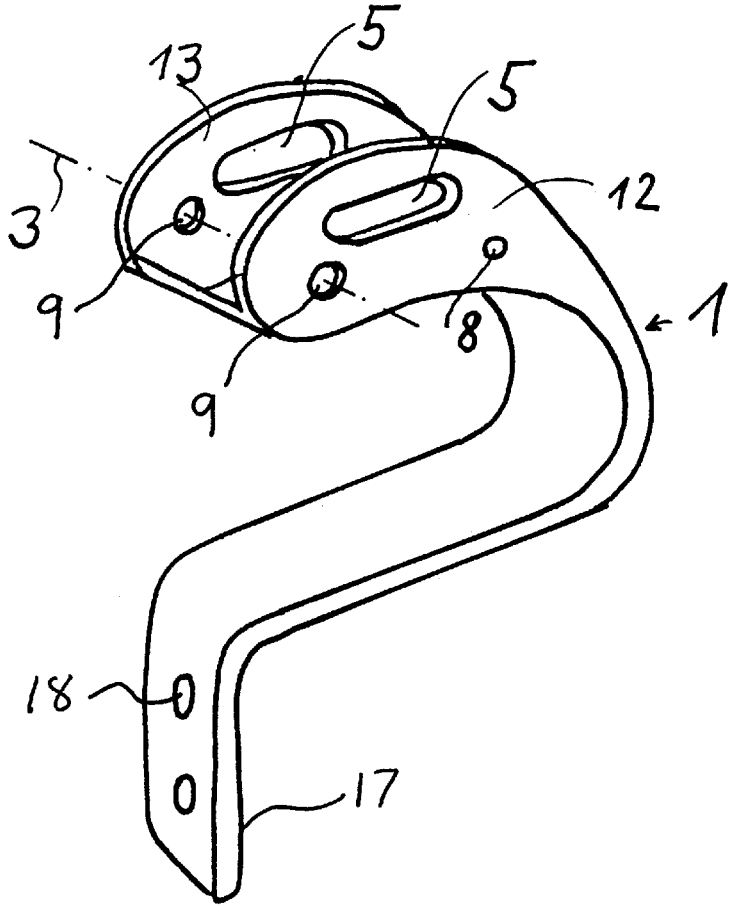

FIG. 1 shows a simplified perspective drawing of stationary hinge part or guide part 2 and pivoting hinge part 1. Stationary hinge part 2 has a gate-shaped structure with two side walls 10 and 11 which are substantially and/or approximately parallel to one another. Each of side walls 10 and 11 have a guide slot 6 defining a guide path. Guide slot 6 in each side wall 10, 11 serves to guide a sliding axis 4 (see FIGS. 2 and 3) which can be in the form of a guided member. Moreover, guide member 4 is preferably under a spring force 7. Guide path 6 is designed with a turning point W. This turning point W allows and/or causes sliding axis 4, under spring force 7, to move into either stop-end position E1 or stop-end position E2 in guide path 6. These two positions E1 and E2 determine the maximum closed and/or locked position and an open position of a device such as, for example, a maintenance flap of an aircraft.

The positions E1 or E2 of the guided member 4 in the guide path 6 determines the position of a flap (not shown) attached to the hinge, i.e. in an open or closed position. The shape of guide path 6 should be continuous, e.g., such that turning point W does not encounter a sharp kink but has instead the form of an elbow, like the path itself. The degree of curvature at turning point W should be greater than in the other parts of guide path 6. An axis 3 is arranged between side walls 10 and 11 and serves as the axis on which hinge part 1, which is located between side walls 10 and 11 of stationary hinge part 2, can pivot. Accordingly, axis 3 is thus a pivoting axis which passes through holes 9 of hinge part 1. Moreover, axis 3 is attached and/or fixed to outer walls 10, 11 of hinge part 2 so as to be retained thereby. Side walls 12 and 13 of hinge part 1 have a guide slot 5 in which sliding axis 4 moves.

When both parts 1 and 2 are assembled, common sliding axis 4 moves in both guide slot 5 of hinge part 1 and guide slot 6 of hinge part 2. In the design example shown, guide slot 6 has a turning point W, but no turning point W is utilized in guide slot 5 of hinge part 1.

Hinge part 1 also has an attachment flange 17 and one or more holes 18 for attaching flange 17 to a device which is to be opened or closed (not shown). Moreover, stationary part 2 has attachment flanges 14 and 15 which extend from side walls 10 and 11. Attachment flanges may also have one or more holes 16 for attaching flanges 14, 15 to a device, e.g., a structural device such a frame.

Figure 2:
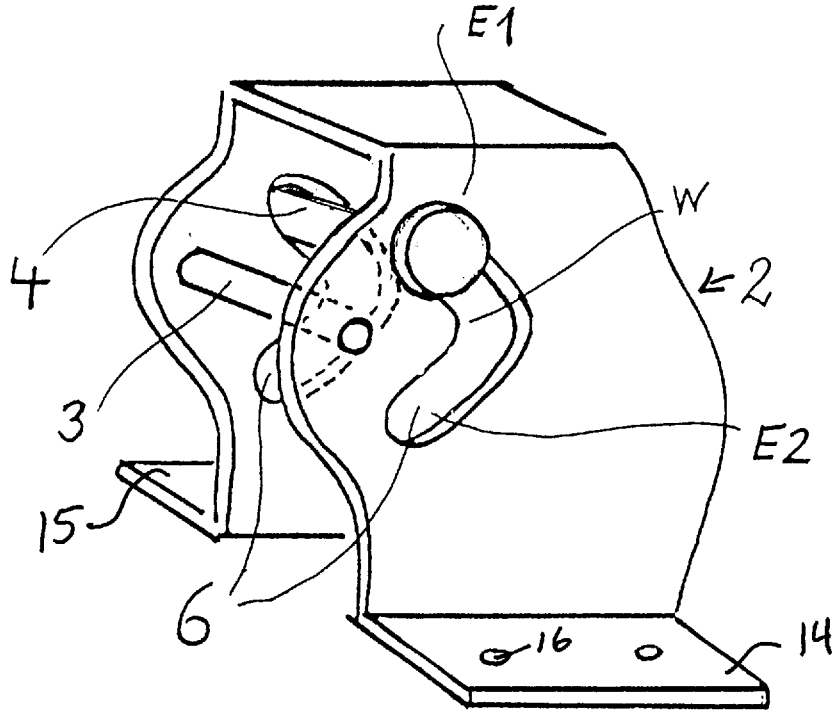
FIG. 2 shows a simplified perspective drawing of the stationary hinge part with the sliding axis in its guide path.

FIG. 2 shows a simplified perspective drawing of stationary hinge part 2 with sliding axis 4 in guide path 6 (note that hinge part 1 is removed for clarity). In this representation, sliding axis 4 is in an end position E1 in guide path 6.

Figure 3:
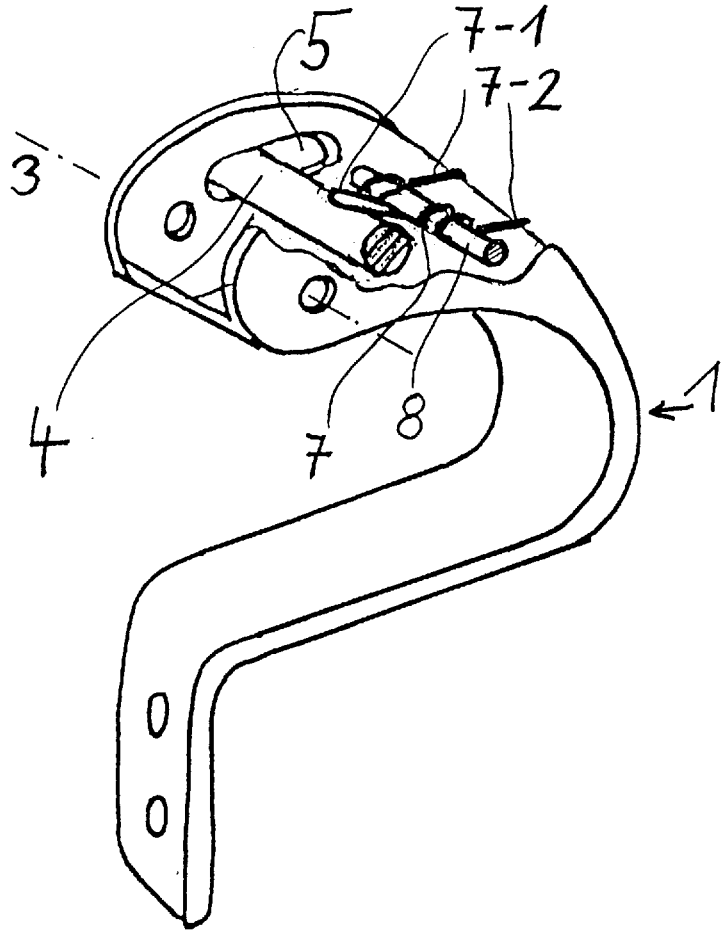
FIG. 3 shows a simplified perspective drawing detail of the pivoting hinge part with the sliding axis in its guide path, which is subjected to the force of a torsion spring.

FIG. 3 shows a simplified perspective drawing detail of pivoting hinge part 1 with sliding axis 4 running in guide path 5 (note that stationary part 2 is removed for clarity). Sliding axis 4 is subjected to the force of a torsion spring 7 mounted on an axis 8.

Outer ends 7-2 of spring 7 are supported on pivoting hinge part 1 in such a way that centre part 7-1 of spring 7 which is designed in the form of a lever, applies pressure to sliding axis 4.

Sliding axis 4 can also receive its pressure from other types of biasing devices or springs such as, e.g., a pressure or tension spiral spring or a plate spring. Such a spring functions to press pivoting hinge part 1 into one of the end positions E1 or E2 of guide path 6. Accordingly, a change in the position of hinged part 1 can only be achieved against the force of this spring.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A pivoting hinge joint having two end stop positions, comprising:

a pivot arm comprising a first guideway;

a stationary guide comprising a second guideway having a bent configuration with a turning point;

a pivot axis for allowing the pivot arm to pivot with respect to the stationary guide;

a guide member adapted to be guided in the first and second guideways;

at least one spring adapted to bias the guide member to one of a first stop position and a second stop position, wherein the turning point is disposed between the first stop position and the second stop position and wherein the pivot arm pivots with respect to the stationary guide between the first stop position and the second stop position.

2. The hinge of claim 1, wherein the pivot axis is attached to the stationary guide.

3. The hinge of claim 1, wherein the turning point forces the guide member against a biasing force of the spring.

4. The hinge of claim 1, wherein the spring forces the guide member against one of the first stop position and the second stop position when the guide member moves away from the turning point.

5. The hinge of claim 1, wherein the spring biases the guide member throughout its movement in the first and second guideways.

6. The hinge of claim 1, wherein the spring biases the guide member throughout a pivoting movement of the pivot arm from the first stop position to the second stop position.

7. The hinge of claim 1, wherein the spring comprises a torsion spring.

8. The hinge of claim 7, wherein the spring comprises one portion which applies pressure to the guide member and another portion which applies pressure to the pivot arm.

9. The hinge of claim 1, further comprising a retaining axis disposed on the pivot arm for holding the spring.

10. The hinge of claim 1, wherein the bent configuration comprises an L-shape slot and wherein the first guideway comprises an elongated slot.

11. The hinge of claim 1, wherein at least one of the pivot axis and the guide member comprise a pin.

12. The hinge of claim 1, wherein the pivot arm comprises two side walls and wherein the second guideway comprises an elongated slot disposed in each side wall, the slots being aligned with one another.

13. The hinge of claim 12, wherein the stationary guide comprises two side walls and wherein the bent configuration comprises an L-shaped slot disposed in each side wall, the L-shaped slots being aligned with one another.

14. The hinge of claim 1, wherein the stationary guide comprises two side walls and wherein the bent configuration comprises an L-shaped slot disposed in each side wall, the L-shaped slots being aligned with one another.

15. A pivoting hinge joint having two end stop positions, comprising:

a pivot arm comprising two side walls and a first guideway, the first guideway comprising an elongated slot;

a stationary guide comprising two side walls and a second guideway, the second guideway comprising an L-shaped slot with a turning point;

a pivot axis pivotally connecting the pivot arm to the stationary guide;

a guide member movably guided in each of the first and second guideways;

a spring biasing the guide member to one of a first stop position and a second stop position, wherein the turning point is disposed between the first stop position and the second stop position and wherein the pivot arm pivots with respect to the stationary guide from the first stop position to the second stop position while the spring biases the guide member.

16. The hinge of claim 15, wherein the turning point forces the guide member against a biasing force of the spring.

17. The hinge of claim 15, wherein the spring forces the guide member against one of the first stop position and the second stop position when the guide member moves away from the turning point.

18. The hinge of claim 15, further comprising a retaining axis disposed on the pivot arm for holding the spring.

19. The hinge of claim 15, wherein at least one of the pivot axis and the guide member comprise a pin.

20. The hinge of claim 15, wherein the stationary guide comprises a U-shaped bracket with substantially perpendicular flanges extending from the side walls.

21. The hinge of claim 15, wherein the pivot arm comprises an attachment flange having at least one hole.

* * * * *